United States Patent [19]

Hollander

[11] Patent Number: 4,744,950

[45] Date of Patent: May 17, 1988

[54] METHOD OF INHIBITING THE CORROSION OF COPPER IN AQUEOUS MEDIUMS

[75] Inventor: Orin Hollander, Langhorne, Pa.

[73] Assignee: Betz Laboratories, Inc., Trevose, Pa.

[21] Appl. No.: 899,117

[22] Filed: Aug. 22, 1986

Related U.S. Application Data

[63] Continuation-in-part of Ser. No. 624,653, Jun. 26, 1984, abandoned.

[51] Int. Cl.[4] ..... C23F 11/14

[52] U.S. Cl. ..... 422/16; 252/390; 422/14

[58] Field of Search ..... 422/14, 16, 327; 210/750; 252/340, 394

[56] References Cited

U.S. PATENT DOCUMENTS 3,985,503 10/1976 O'Neal .
4,522,285 11/1985 D'Errico ..... 252/390

FOREIGN PATENT DOCUMENTS 142873 11/1981 Japan .
152476 9/1982 Japan .
1065995 4/1967 United Kingdom .

OTHER PUBLICATIONS

Derwent Abstract of Japanese 56-142873, 11-7-81.
Cotton et al., "Benzotriazole and Related Compounds as Corrosion Inhibitors for Copper", Brit. Corrosion Journal, vol. 2, Jan. 1967.
Harrison et al., "Advances in the Control of Copper and Copper Alloy Corrosion in Chlorinated Cooling Waters," Calgon Corp., 1986.

*Primary Examiner*—Barry S. Richman
*Assistant Examiner*—William R. Johnson
*Attorney, Agent, or Firm*—Alexander D. Ricci; Bruce E. Peacock

[57] ABSTRACT

A method of providing a durable, long lasting chemically resistant, pH tolerant, corrosion inhibiting film on the surfact of copper or copper containing metal in contact with an aggressive aqueous system is disclosed. The copper or copper containing metal generally composes a structure of dynamic cooling water system, and protection is afforded thereto by intermittently feeding to the aqueous medium a sufficient amount of a $C_3$ to $C_6$ alkyl substituted benzotriazole.

15 Claims, 4 Drawing Sheets

FIG. 1. CORROSION RATE VS TIME TOLYLTRIAZOLE TREATMENT

Figure 1:
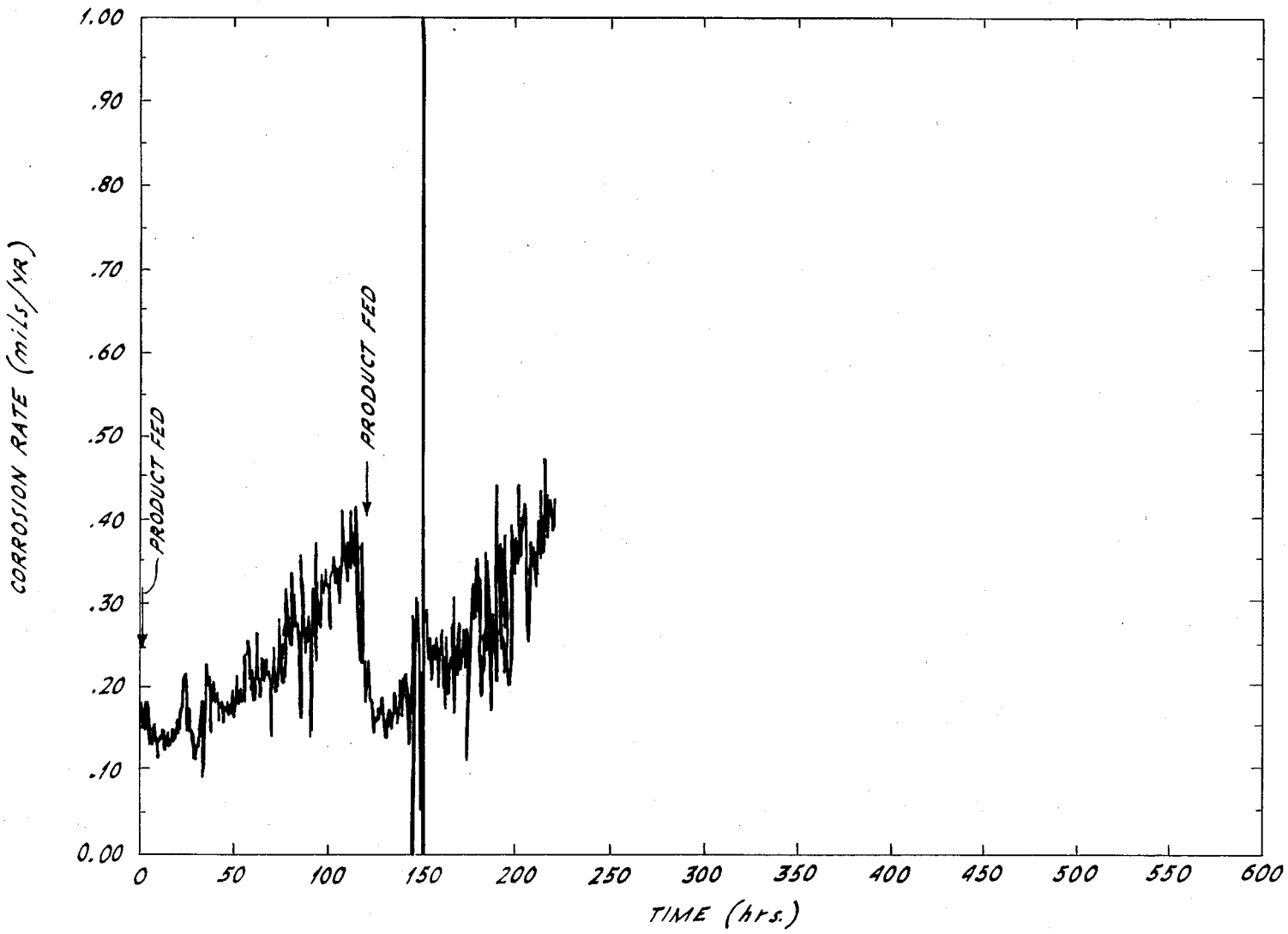

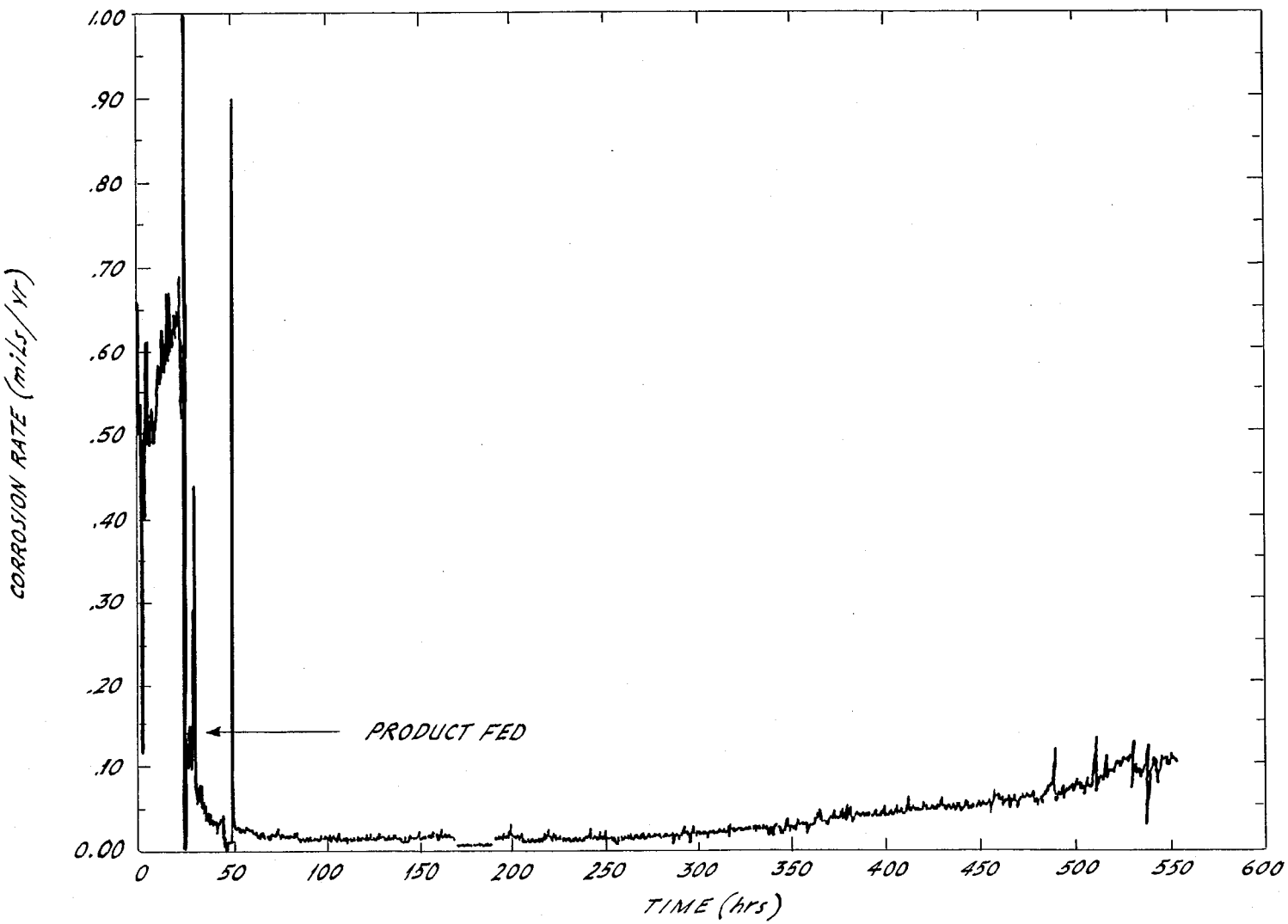
FIG. 3. CORROSION RATE vs TIME BUTYLBENZOTRIAZOLE TREATMENT

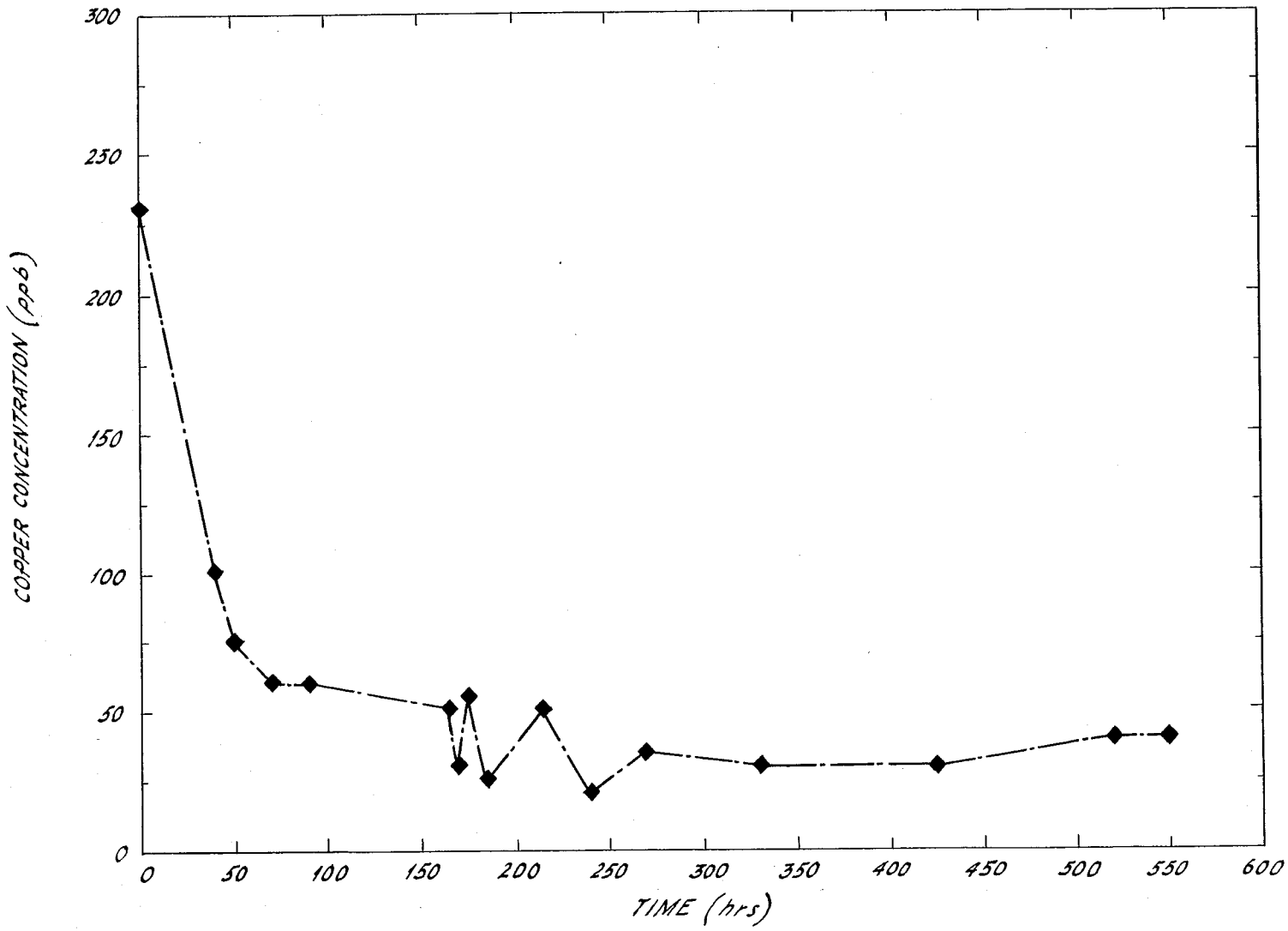
FIG. 4. COPPER CONC. VS TIME BUTYLBENZOTRIAZOLE TREATMENT

METHOD OF INHIBITING THE CORROSION OF COPPER IN AQUEOUS MEDIUMS

This application is a continuation-in-part of application Ser. No. 624,653 filed June 26, 1984, now abandoned, which is incorporated in its totality herein by reference.

BACKGROUND OF THE INVENTION

In many industrial processes, undesirable excess heat is removed by the use of heat exchangers in which water is used as the heat exchange fluid. Copper and copper-bearing alloys are often used in the fabrication of such heat exchangers, as well as in other parts in contact with the cooling water, such as pump impellers, stators, and valve parts. The cooling fluid is often corrosive towards these metal parts by virtue of containing aggressive ions and by the intentional introduction of oxidizing substances for biological control. The consequences of such corrosion are the loss of metal from the equipment, leading to failure or requiring expensive maintenance, creation of insoluble corrosion product films on the heat exchange surfaces, leading to decreased heat transfer and subsequent loss of productivity, and discharge of copper ions which can then "plate out" on less noble metal surfaces and cause severe galvanic corrosion, a particularly insidious form of corrosion. Also, copper is a toxic substance, and its discharge to the environment is undesirable.

Accordingly, it is common practice to introduce corrosion inhibitors into the cooling water. These materials interact with the metal to directly produce a film which is resistant to corrosion, or to indirectly promote formation of protective films by activating the metal surface so as to form stable oxides or other insoluble salts. However, such protective films are not completely stable, but rather are constantly degrading under the influence of the aggressive conditions in the cooling water. Because of this, a constant supply of corrosion inhibiting substances, sufficient to the purpose, must be maintained in the cooling water. But because many cooling systems are open, a constant depletion of these corrosion inhibiting substances occurs, requiring a continuous addition of fresh corrosion inhibiting substances so as to maintain, within defined limits, a concentration of such corrosion inhibiting substances sufficient to the purpose of maintaining good corrosion inhibition. The need to constantly replace the corrosion inhibiting substances leads to increased costs of operation, and often requires expensive equipment to monitor and regulate the addition of these substances.

Another undesirable feature of the continuous feed requirements of these inhibitors is the continuous discharge of these materials into the environment. Since many of these corrosion inhibiting substances have measurable toxicities for various aquatic species, their continuous discharge presents a chronic hazard to the environment. The benzotriazoles are also somewhat problematic in this regard.

In the treatment of copper-bearing metallurgies an additional complication arises. Unlike the corrosion products of ferrous metals, which quickly form insoluble oxides which will not react further, the corrosion products of copper-bearing metallurgies, namely cupric and cuprous ions, remain soluble and are reactive towards the inhibitors specific for such metals. As a result, the copper-specific inhibitors are further depleted by deactivation. Under certain circumstances, such as acid spills, process leaks, overfeeds of oxidizing biocides, or inadvertent loss of inhibitor feed, the corrosion rate of the copper-bearing metallurgies can increase to such an extent that all the remaining inhibitor is depleted by deactivation. Unless this condition is recognized and specific recovery procedures are instituted, it is clear that no useful effect of additional maintenance dosages of the inhibitor will be obtained since the inhibitor will be deactivated at a rate equal to its addition rate.

Use of substituted benzotriazoles as corrosion inhibitors is a well-known practice. U.S. Pat. No. 4,060,491 relates to the use of 5-alkylbenzotriazoles in lubricants for the reduction of wear of steel surfaces. In U.S. Pat. No. 4,519,928, it is disclosed that N-t-alkylated benzotriazoles are useful for imparting oxidation and corrosion resistance to oleaginous lubricant compositions. British Pat. No. 1,065,995 teaches that 5-alkyl substituted benzotriazoles are effective in reducing corrosion or tarnish of copper items in glycolic solvents or in lubricants, or to resist tarnishing in the presence of atmospheric sulfides. The use of substituted benzotriazoles as metal inactivators in detergent compositions is described in U.S. Pat. No. 2,618,606. Another ferrous metal corrosion inhibitor is claimed in U.S. Pat. No. 3,895,170, in which 1-hydroxy-4(5) substituted benzotriazoles are the objects of the invention.

More directly related to the present invention are the teachings of U.S. Pat. No. 4,406,811, in which benzotriazole or tolyltriazole is combined with other components to form an effective multimetal corrosion inhibitor for aqueous systems.

Japanese Pat. No. 56-142873 relates to a reaction product of alkylbenzotriazoles and phosphonic acids for use in aqueous systems in concentrations of 10–5000 ppm; the object being to improve the dissolution rate of the benzotriazole. Another Japanese patent, No. 57-152476, pertains to the combination of benzotriazoles and cyclic amines for inhibiting metallic corrosion in engine cooling systems, industrial heat exchangers, brake fluids, cutting oils, and glycolic oils.

However, of those disclosures that relate to the inhibition of corrosion of copper-bearing metals in aqueous systems, all require the constant presence of the inhibitor in the aqueous medium. It is clear from the examples provided that the inhibitor must be continuously present in the aqueous phase in order to maintain adequate protection. All of the examples cited fail to address the method of inhibiting corrosion by the formation of a stable and durable inhibiting film which does not require a maintenance level of inhibitor in the aqueous medium.

GENERAL DESCRIPTION OF THE INVENTION

Accordingly, it is an object of this invention to provide a means of protecting copper-bearing metallurgies in open, aqueous cooling systems from corrosion so as to overcome the aforementioned deficiencies of the existing technology, namely: the need for expensive and complicated feed and monitoring equipment, the susceptibility of systems so treated to upset conditions, and to abate the discharge of toxic copper and corrosion inhibiting substances into the environment.

It has been found that when copper-bearing metals are treated with compounds of the formula

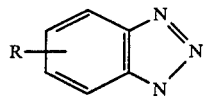

where R is a $C_3$ to $C_6$ and preferably $C_4$ to $C_5$, and especially $C_4$, linear or branched hydrocarbon, the rate of copper corrosion decreases from 10 to 100-fold over the decrease of copper corrosion obtained when R is H, $CH_3$, $C_2H_5$ or $C_nH_{2n+1}$, where n is an integer greater than six, when applied on an equal weight basis. This is an unexpected and novel finding, since the increase in molecular weight upon increasing the hydrocarbon chain length will result in a lower overall concentration of the inhibitor when applied on an equal weight basis.

Also, it has been found that the resistance to breakdown of inhibitive films formed from these molecules under dynamic conditions of circulation, heat, pH fluctuations and introduction of oxidizing biocides is similarly enhanced.

Thus, the materials of this invention provide a means for overcoming the objectionable deficiencies of commonly employed corrosion inhibitors for copper and copper-bearing alloys in service in aqueous, open cooling systems. More specifically, this invention relates to a process of treating copper-bearing metal components of an aqueous open cooling system for the inhibition of corrosion by adding to the cooling water an amount from 0.1 to 100 parts by weight for every 1,000,000 parts by weight of water depending on the degree of corrosiveness of the water (parts per million). Preferably, an amount from 1 to 50 parts per million, and especially 3 to 5 parts per million, may be added. Because of the long lasting and durable nature of the protective film thus formed, the application of the instant material may be carried out on an intermittent basis. The frequency of these additions will be dictated by operating conditions and economy of usage. Obviously, continuous addition of the instant material is also a viable means of usage, but for the aforementioned reasons, a non-preferred embodiment of this invention. In the interval between additions, no detectable levels of the inhibitive substance are present in the circulating cooling fluid, having been removed by blowdown. The inhibitive film thus formed has been shown to be present and fully effective for a period exceeding 30 days after the removal of the inhibitor from the circulating water. In addition, subjecting the system to pH depression and overfeeds of oxidizing biocides does not lead to film disruption or loss of inhibitory power. By contrast, inhibitive films formed by benzotriazole and by tolyltriazole (R=H or $CH_3$) are completely removed within 50 to 100 hours after treatment, and even more rapid loss of inhibitory power is observed if pH depressions or oxidizing biocide overfeeds are experienced.

SPECIFIC EXAMPLES

EXAMPLE 1

A test water shown in Table A was circulated at 7 feet per second through a test loop in which test coupons of admiralty brass and 90/10 copper nickel were installed. Additionally, electrochemical corrosion rate probes of admiralty brass and 90/10 copper nickel were placed in the test loop. A heat transfer tube of 90/10 copper nickel was also present. That tube was subjected to a heat load of 8000 BTU/ft$^2$-hr.

TABLE A

| Test Water Composition for Examples 1 and 2 | |
|---|---|
| pH | 7.5–7.7 |
| $Ca^{+2}$ (ppm as $CaCO_3$) | 660 |
| $Mg^{+2}$ (ppm as $CaCO_3$) | 480 |
| $SiO_2$ (ppm) | 9.2 |
| $NaHCO_3$ (ppm as $CaCO_3$) | 40 |
| Temperature | 120° F. |

To the sump of the test unit was added a quantity of inhibitor. A fresh supply of the uninhibited test water was fed to the system, with continuous overflow, so as to replace one system volume every 24 hours. After three days, no detectable level of inhibitor was found in the recirculating water. The results of this testing are shown in Table I.

TABLE I

| Corrosion Rate vs. Time for Inhibitors | | | | | | |
|---|---|---|---|---|---|---|
| | Corrosion Rate (mpy) | | | | | |
| Time | Control (no treatment) | | Tolyltriazole | | n-Butyl-Benzotriazole | |
| (Hrs) | ADM | 90/10 | ADM | 90/10 | ADM | 90/10 |
| | 2.0 | 1.9 | | | | |
| 0 | — | — | 0.20 | 0.99 | 0.12 | 0.30 |
| 42 | — | — | 0.1 | 0.05 | 0.1 | 0.03 |
| 72 | — | — | 0.1 | 0.07 | 0.1 | 0.03 |
| 137 | — | — | — | 0.93 | 0.1 | 0.03 |
| 161* | — | — | 1.0 | 1.84 | 0.1 | 0.03 |
| 480 | — | — | test terminated | | 0.1 | 0.03 |

*inhibitor concentration = 0 ppm
Note 1.
While measurements were taken at additional periodic intervals during the span of the test, the time frames chosen were those which coincided with the two triazoles tested.

As is evident from the data, the protection afforded by tolyltriazole completely degraded within three days of the depletion of the inhibitor. By contrast, the protection afforded by the inhibitor of this invention was not diminished after 20 days.

EXAMPLE 2

The test procedure of Example 1 was repeated, except that, commencing 24 hours after the addition of the inhibitor, sodium hypochlorite was added to the system so as to produce a free residual of 1 ppm of chlorine. The chlorine dosage was repeated every 24 hours. From the results shown in Table II, it is seen that the product of this invention has a significant resistance to chlorination, whereas the comparison example has none.

TABLE II

| Corrosion Rate vs. Time for Inhibitors with Chlorination | | | | |
|---|---|---|---|---|
| | Corrosion Rate (mpy) | | | |
| Time | Tolyltriazole | | n-Butyl Benzotriazole | |
| (Hrs) | ADM | Cu/Ni | ADM | Cu/Ni |
| 0 | | | | |
| 1 | 0.1 | — | 0.2 | 0.17 |
| 23* | 0.1 | 0.03 | 0.1 | 0.03 |
| 41* | 0.19 | 0.17 | 0.1 | 0.05 |
| 65* | 1.44 | 0.91 | 0.1 | 0.05 |
| 90* | test terminated | | 0.15 | 0.04 |
| 111* | | | 0.52 | 1.02 |
| 139* | | | 4.7 | 1.34 |
| 144 | | | 3.2 | 0.31 |

*just prior to chlorine addition
See Note 1, Table I

EXAMPLE 3

In order to examine the resistance to low pH conditions, a test electrochemical cell was used. A copper electrode pretreated in 100 ppm of inhibitor was then placed in uninhibited test solution consisting of 0.1M $Na_2SO_4$, adjusted to pH 7. The electrode was then subjected to a triangular potential sweep waveform through the anodic and cathodic regions of the $Cu^0/Cu^{+2}$ reaction of the electrode. The pH was progressively lowered, and the sweep was repeated at each value of pH. Table III tabulates the cathodic peak currents, which are proportional to the degree of anodic dissolution of the test electrode.

TABLE III

Cyclic Voltammetry Data for pH-related Film Stability

| | Peak Cathodic Current ($uA/cm^2$) | |
|---|---|---|
| pH | Tolyltriazole | n-Butyl Benzotriazole |
| 7 | 0 | 0 |
| 6 | 0 | 0 |
| 5 | $2.3 \times 10^{-3}$ | 0 |
| 4 | $2.1 \times 10^{-2}$ | $4.5 \times 10^{-3}$ |
| 3 | $2.1 \times 10^{-2}$ | $1.3 \times 10^{-2}$ |
| 2 | 1.8 | $1.9 \times 10^{-2}$ |

EXAMPLE 4

Figure 2:
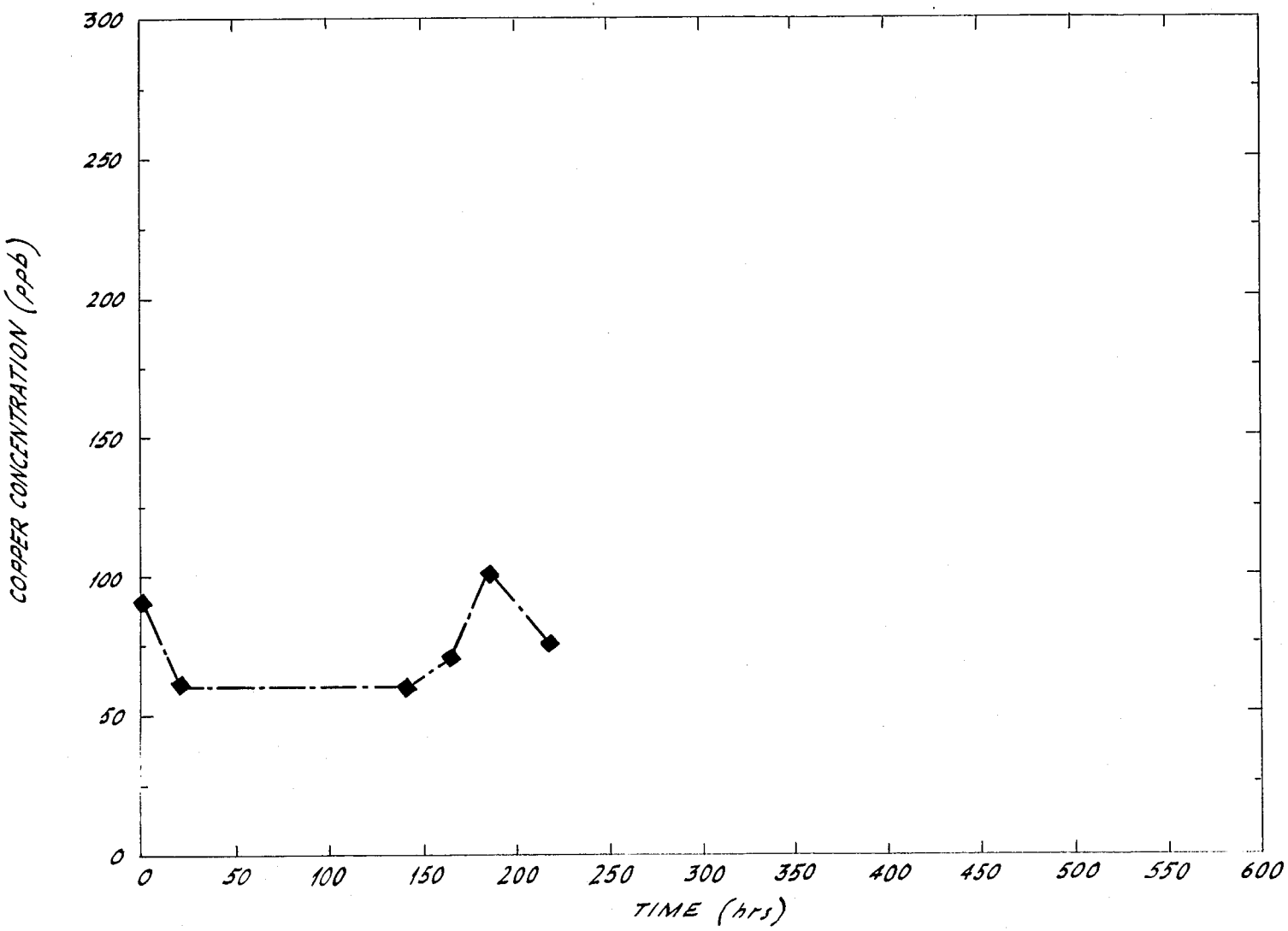

An industrial cooling system with a water characterized in Table B was alternately treated with tolyltriazole and the subject compound of this invention. The system volume as $1.8 \times 10^6$ gallons, recirculation rate of 121,000 gallons per minute, and a 90/10 copper-nickel heat exchanger of 129,670 square feet of surface area. FIG. 1 details the corrosion rate measured instantaneously of a 90/10 copper-nickel electrode when the system was treated with a single dose of tolyltriazole. FIG. 2 shows the copper ion measured at the system discharge. FIG. 3 details the behavior for the same system when treated with the material of this invention and FIG. 4 shows the copper ion concentration at the discharge point.

TABLE B

Test Water Composition for Example 4

| | |
|---|---|
| pH | 7.9 |
| $SO_4^=$ (ppm) | 196 |
| $Cl^-$ (ppm) | 98 |
| Ca (ppm as $CaCO_3$) | 270 |
| Mg (ppm as $CaCO_3$) | 115 |
| Cu (ppm) | 0.23 |
| Fe (ppm) | 0.18 |
| $SiO_2$ (ppm) | 24 |
| TSS | 10.4 |
| Conductivity ($uS\text{-}cm^{-1}$) | 970 |

I claim:

1. A method of providing a durable, long lasting chemically resistant, pH tolerant, corrosion inhibiting film on the surface of copper or copper containing metal in contact with an aggressive dynamic aqueous system substantially free of glycols having a pH substantially neutral to alkaline which comprises adding in a non-continuous manner a sufficient amount for the purpose of an alkyl benzotriazole having the formula

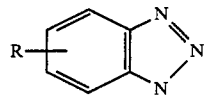

where R is a $C_3$ to $C_6$ linear hydrocarbon, and permitting contact of said triazole for a time sufficient to provide said film and thereafter discontinuing the feed of said triazole and permitting any residual triazole to deplete.

2. A method according to claim 1, wherein R is a $C_3$ or $C_4$.

3. A method according to claim 2 wherein from 0.1 to 100 ppm of alkyl benzotriazole is added to the system.

4. A method according to claim 3 wherein from about 1 to 50 ppm is added.

5. A method according to claim 4 wherein the alkyl benzotriazole is fed intermittently.

6. A method according to claim 5 wherein the time frames of the intermittent feed are predicated upon the durability of the film formed.

7. A method according to any one of claims 2, 4, 5 or 6 wherein the alkyl benzotriazole is butyl benzotriazole.

8. A method of providing a durable, long lasting chemically resistant, pH tolerant, corrosion inhibiting film on the surface of copper or copper containing metal of an open cooling water system which copper or metal is in contact with a dynamic aggressive aqueous medium of said system, which medium is substantially free of glycols and has a pH substantially neutral to alkaline, which method comprises adding in a non-continuous manner a sufficient amount for the purpose of an alkyl benzotriazole having the formula

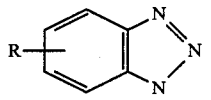

where R is a $C_3$ to $C_6$ linear hydrocarbon, and permitting contact of said triazole for a time sufficient to provide said film and thereafter discontinuing the feed of said triazole and permitting any residual triazole to deplete.

9. A method according to claim 8 wherein R is $C_4$ or $C_5$.

10. A method according to claim 9 wherein from 0.1 to 100 ppm of alkyl benzotriazole is added to the system.

11. A method according to claim 10 wherein from about 1 to 50 ppm is added.

12. A method according to claim 11 wherein the alkyl benzotriazole is fed intermittently.

13. A method according to claim 12 wherein the periods for the intermittent feed are predicated upon the durability of the film formed.

14. A method according to any one of claims 9, 10, 11 or 12 wherein the benzotriazole is n-butyl benzotriazole.

15. A method according to claim 14 wherein the cooling water system is an open recirculating water system.

* * * * *